US007716900B2

(12) United States Patent
Schmetzer

(10) Patent No.: US 7,716,900 B2
(45) Date of Patent: May 18, 2010

(54) METHOD FOR STRAPPING A PACKAGE WITH A STRAPPING MACHINE THAT INCLUDES A MOTOR DRIVE HAVING A DRIVE SHAFT THAT ROTATES 360° WITHIN A STRAPPING CYCLE AND CONTROLS WORK COMPONENTS INCLUDING AT LEAST ONE CLAMPING DEVICE FOR THE STRAP TO BE STRAPPED

(75) Inventor: Helmut Schmetzer, Bayreuth (DE)

(73) Assignee: SSB Strapping Systeme Bayreuth GmbH, Bayreuth (DE)

( * ) Notice: Subject to any disclaimer, the term of this patent is extended or adjusted under 35 U.S.C. 154(b) by 0 days.

(21) Appl. No.: 12/150,024

(22) Filed: Apr. 24, 2008

(65) Prior Publication Data

US 2008/0276577 A1 Nov. 13, 2008

(30) Foreign Application Priority Data

May 10, 2007 (DE) ..... 10 2007 022 438

(51) Int. Cl.
*B65B 13/04* (2006.01)

(52) U.S. Cl. ..... 53/399; 53/589; 100/33 PB

(58) Field of Classification Search ..... 53/399, 53/582, 589; 100/32, 33 R, 33 PB, 34
See application file for complete search history.

(56) References Cited

U.S. PATENT DOCUMENTS

| | | | | |
|---|---|---|---|---|
| 4,016,023 | A | 4/1977 | Takami | |
| 4,527,379 | A | 7/1985 | Bartzick et al. | |
| 4,559,767 | A | 12/1985 | Takami | |
| 4,850,179 | A | 7/1989 | Takami | |
| 4,938,009 | A | 7/1990 | Takami | |
| 5,513,482 | A | 5/1996 | Nagashima et al. | |
| 5,615,538 | A | 4/1997 | Miyashita | |
| 7,357,289 | B2 | 4/2008 | Schmetzer | |
| 7,412,815 | B2 * | 8/2008 | Schmetzer | 53/589 |
| 2005/0167469 | A1 * | 8/2005 | Schmetzer | 228/44.3 |
| 2007/0181261 | A1 * | 8/2007 | Schmetzer | 156/583.1 |

FOREIGN PATENT DOCUMENTS

| | | |
|---|---|---|
| DE | 25 32 217 | 2/1976 |

(Continued)

*Primary Examiner*—Louis K Huynh
(74) *Attorney, Agent, or Firm*—Jordan and Hamburg LLP

(57) ABSTRACT

A method for strapping a package with a strapping machine that includes a motor drive having a drive shaft that rotates 360° within a strapping cycle and controls work components including at least one clamping device for the strap to be strapped. The clamping of the leading strap end, fed in in a strap guide frame, for the strap to be strapped in the subsequent strapping cycle occurs in the current strapping cycle in the time between the beginning of the removal of the package already strapped in the current strapping cycle and the end of the addition of a new package to be strapped, whereupon the drive stops. After the conclusion of the tensioning process for the fed-in strap about the package, for performing the strapping process, the drive rotates continuously 360° without an intermediate stop in the new strapping cycle until the new leading strap end has been clamped.

5 Claims, 3 Drawing Sheets

FOREIGN PATENT DOCUMENTS

| | | |
|---|---|---|
| DE | 33 00 039 | 7/1983 |
| DE | 32 20 445 | 12/1983 |
| DE | 38 19 868 | 6/1988 |
| DE | 38 13 723 | 11/1988 |
| DE | 44 25 703 | 1/1995 |
| DE | 44 25 908 | 1/1995 |
| DE | 103 23 171 | 12/2004 |
| JP | 02032917 | 2/1990 |

* cited by examiner

METHOD FOR STRAPPING A PACKAGE WITH A STRAPPING MACHINE THAT INCLUDES A MOTOR DRIVE HAVING A DRIVE SHAFT THAT ROTATES 360° WITHIN A STRAPPING CYCLE AND CONTROLS WORK COMPONENTS INCLUDING AT LEAST ONE CLAMPING DEVICE FOR THE STRAP TO BE STRAPPED

BACKGROUND OF THE INVENTION

Strapping machines of the type described are known and are used to strap, that is, to encircle, a package, for instance a stack of catalogs, with a plastic strap. Basically, a strap comprising plastic is guided about the package, tensioned, clamped and cut, and welded by heating by means of a welding device, whereupon the strapped package is conveyed out of the strapping machine and a new package to be strapped is supplied.

A strapping machine has a strap guide frame into which the strap is fed via a feeding device, and a strap guide in the area beneath the package in which the strap to be fed is guided and in which the leading strap end is captured. For tensioning the strap, it can be brought out of the strap guide frame and positioned directly on the package. Furthermore provided, is a clamping device comprising two separate clamping jaws, of which the one clamping jaw clamps the leading strap end and, after tensioning, the other clamping jaw clamps the other strap end, both disposed adjacent to an overlap area in which the welding occurs. Furthermore provided is a welding device including a welding tongue that is moved between the strap ends in the overlap area for heating them and a pressing device and a counterpressure plate, the pressing device being moved against the counter-pressure plate from below, and the heated strap ends that are to be welded being disposed therebetween. The movable functional components are controlled via a drive motor or a drive shaft, driven thereby, with which the different functional components are directly or indirectly motion-coupled. Frequently cam disk couplings are used, that is, one or a plurality of cam disks are arranged on the drive shaft and run at or on the corresponding catch segment of a functional component and are moved correspondingly as a function of the cam disk profile.

The drive shaft rotates 360° one time during a strapping cycle. In known machines, in the start position, that is, at the beginning of a strapping cycle, the new package to be strapped is already disposed in the strapping machine, that is, in the strap guide frame, the movable strap guide is disposed in the inserted work position, that is, it can guide the strap, and the strap itself has already been fed in and captured at its leading end. At this point in time, the drive motor is off, so the drive shaft is not rotating. Then the motor is started in a first work step, and the so-called set-up phase begins. The motor starts up in order to actuate the right clamping jaw of the clamping device via the drive shaft so that this clamping jaw clamps the leading strap end. As soon as this has occurred, the motor brakes again and stops, because then the tensioning step occurs next, which means that the strap, which naturally was fed in with a strap length significantly longer than the length required for strapping, is guided back into the machine into a strap storage unit and tensioned securely about the package. During this time the motor, or the drive shaft, is idle, because the tensioning process is performed by a separate tensioning device. Only then does the motor or drive shaft start up again in order to actuate the left clamping jaw in the next work step to clamp the strap at the other end, now cut, and in order to actuate the other functional components for the welding (for this the strap guide is moved out of the work area, the welding device is moved into the work area, after heating it is moved back out, and the pressing device is moved against the pressure plate to perform the welding). After the welding has concluded, while the motor drive is still running, the pressing device is moved back into the starting position and the pressure plate is moved out of the work area so that the package, now strapped, is exposed and can be exchanged for another package. As soon as the strapped package has been removed, the counterpressure plate is moved back into the work position together with the strap guide, and the motor stops—its work cycle has concluded. This is just followed by the strap for the next strapping process being fed in. The motor work cycle has concluded with the second stop, however, the motor or the drive shaft has rotated 360° one time. Then the new motor work cycle begins, namely, when the motor briefly turns again in order to actuate the right clamping jaw, and it stops again immediately thereafter because the tensioning process begins then as described in the foregoing.

It can be seen that a two-stop method is created in the known strapping machines. The motor starts up two times within one cycle and stops two times, the first start-up in the set-up phase being used only to actuate the right clamping jaw for fixing the leading strap end, whereupon the motor stops to enable the tensioning. This is disadvantageous not only for reasons of wear, but it also increases the time required for strapping one package so that machine throughput is necessarily reduced because of this.

The underlying problem of the invention is to provide a method that facilitates more rapid strapping and leads to less wear.

SUMMARY OF THE INVENTION

For solving this problem, in a method of the type cited in the foregoing it is inventively provided that the clamping of the leading strap end, fed in in a strap guide frame, for the strap to be strapped in the subsequent strapping cycle occurs in the current strapping cycle in the time between the beginning of the removal of the package already strapped in the current strapping cycle and the end of the addition of a new package to be strapped, whereupon the drive stops, and, after the conclusion of the tensioning process for the fed-in strap about the package, for performing the strapping process, rotates continuously 360° without an intermediate stop in the new strapping cycle until the new leading strap end has been clamped.

In the inventive method the clamping of the leading strap end, that is, the actuation of the right clamping jaw, is performed with particular advantage in the time that the package is exchanged. Within one strapping cycle, relative to the drive time for the motor, the latter or the drive works continuously, and it only stops a single time, specifically at the end of the strapping cycle or the latter is concluded when the motor stops. In the starting position, that is, at the beginning of a new strapping cycle, the right clamping jaw has already been actuated and closed, which means that the leading end has already been clamped. Once the package has been exchanged, therefore, since the leading strap end is already clamped, it is possible to begin with the tensioning immediately, whereupon, when the tensioning has concluded, the drive starts up one single time within the entire cycle in order to actuate the left clamping jaw and then continues to works continuously, in order also to actuate the other functional components, until the end of the drive cycle, when, after the leading strap end has been fed in and captured, the right clamping jaw is brought into the clamping position as the last motor-controlled action within the strapping cycle. The motor then stops so that the exchange of the package, which has already begun, continues and is concluded, whereupon, as soon as the new package is in position, tensioning can begin in the next strapping cycle.

In the inventive method, consequently, the motor is started up and stopped only one time within a cycle, otherwise it rotates 360° continuously. After the end of the strapping cycle, relative to the drive activity, this is enabled in the time for the current package exchange and the clamping device is actuated as the last drive-controlled action so that the starting position, in which the leading strap end is already clamped, is assumed. The motor is necessarily less stressed because it does not have to start up and brake twice within one cycle, but rather only once, and furthermore a more rapid manner of working is possible since it is possible to gain time because the one drive and braking process is omitted. Machine throughput can be increased as a result.

The removal of the strapped package preferably begins immediately after a pressure plate for the welding of the strap is moved out of the strap guide area using the movement controlled by the drive shaft and when the clamping device is open, preferably in the remaining angle of rotation interval for the driveshaft starting at 160°, preferably starting at/up to 200°. Starting at this angle of rotation, that is, about 160° or e.g. 200°, the counterpressure plate, which due to the welding is disposed between the welded strap segment and the package, is removed from this area and the package is exposed so that it can then immediately be removed. Then, in the remaining angle of rotation interval between at least 160° (or for instance 200°) and 360° shaft rotation, there remains adequate time for the package exchange, which should however begin as soon as possible within this interval. The new strap is then fed in for instance starting at approx. 300° angle of rotation, so that adequate angle of rotation remains for actuating the right clamping device and for clamping the leading strap end, whereupon the rotation cycle has concluded. The motor stops, and the new rotation or strapping cycle does not begin until the next rotation begins, specifically when it is necessary to actuate the left clamping jaw, and then proceeds continuously until the end of the cycle. The number of controlled activities for the functional elements thus occurs in the angle of rotation angle between 0° and e.g. 160° or 200°, while adequate time is obtained over the rest of the angle of rotation interval for performing the package exchange.

In addition to the method, the invention furthermore relates to a strapping machine embodied for performing the method of the type described.

Additional advantages, features, and details of the invention result from the exemplary embodiment described in the following and using the drawings.

DETAILED DESCRIPTION OF THE INVENTION

Figure 1:
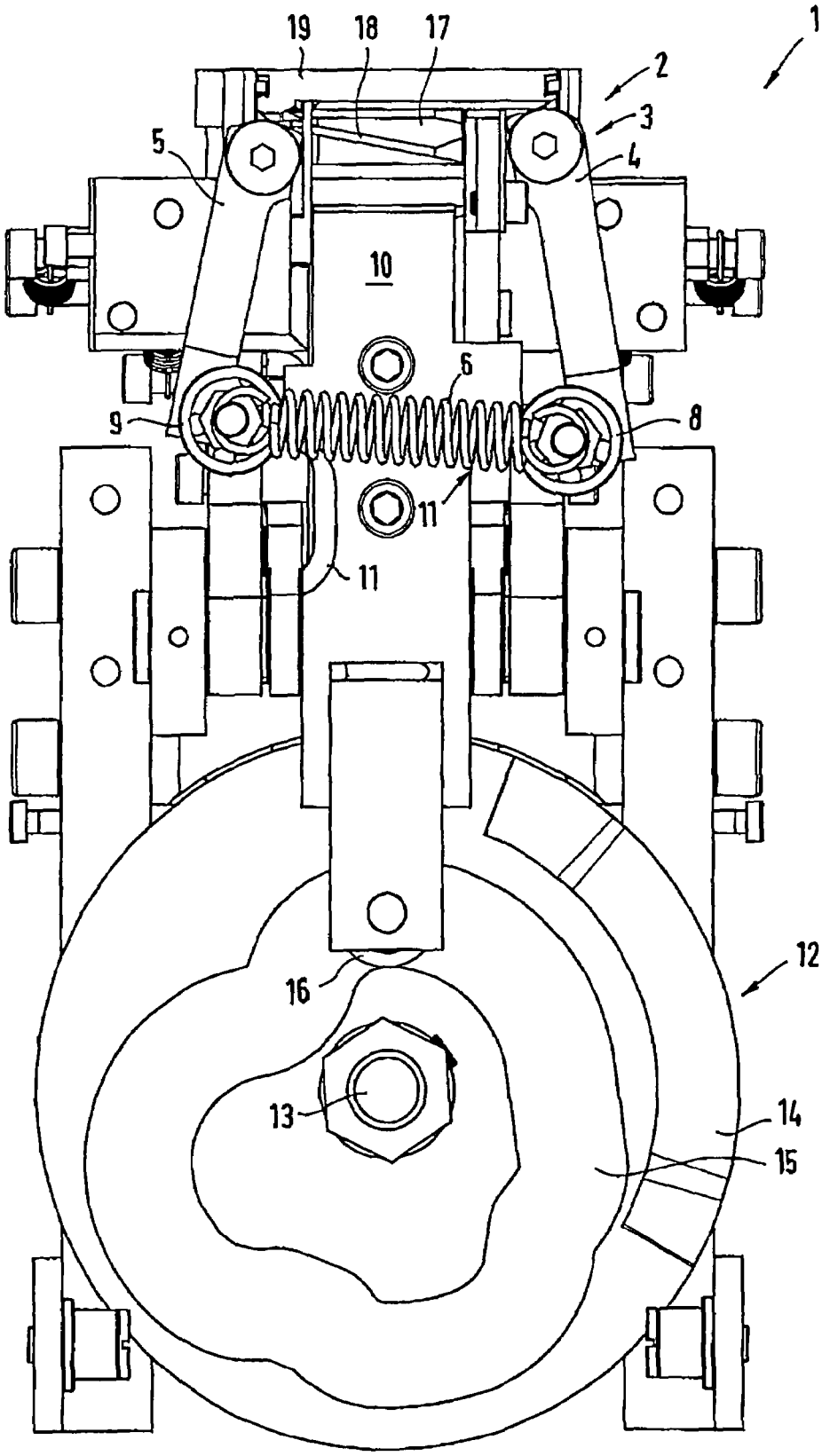
FIG. 1 depicts the principle for a strapping machine according to an embodiment of the invention.

FIG. 1 depicts an inventive strapping machine 1, only essential components being depicted here for reasons of clarity. Depicted are a welding head 2, including a clamping device 3 having a right clamping jaw 4 and a left clamping jaw 5 that fix the strap, which will be described in greater detail in the following. Both are pre-stressed via a spring 6 and run via rollers 8, 9 on the outer surface of a pressing device 10 that can be moved vertically. Both sides of the lower area of the exterior of the pressing device 10 are provided with a curve structure 11 that follows the rollers 8, 9 and via which the movement occurs, in this case pivoting of the clamping jaws 4, 5 for pressing or releasing the strap. The pressing device 10 itself can be moved vertically as described. Control occurs via a drive 12, of which here, only the drive shaft 13, which is coupled to a motor, is depicted (not shown in greater detail). Arranged on the drive shaft 13 are a plurality of cam disks 14, of which only one is depicted here, and it has a guide groove 15 in which a running wheel 16 engages, the latter itself being connected to the pressing device 10. The vertical movement during a rotation of the cam disk 14 is controlled in accordance with the shape of the guide groove.

Furthermore depicted is a strap guide device 17 that has a center guide channel 18 in which the fed-in strap is guided into a strap guide frame (not shown in greater detail here). The strap guide device 17 is overlapped by a counterpressure plate 19, against which the pressing device 10 presses when the molten strap segments are welded in order to join them securely. For the fusing, a welding device 23, including a welding tongue 24, is provided (see FIGS. 2 and 3), which is not depicted in greater detail for reasons of clarity, but which can be inserted into the area between the pressing device 10 and counterpressure plate 19 and can be moved out of this area. The functional components, "strap guide device 17, counterpressure plate 19, welding tongue 24", can also be controlled via the drive 12 in a corresponding manner, that is, they are each also coupled where necessary to a cam disk in a suitable manner. The plurality of cam disks are arranged successively on the drive shaft 13. The individual functional components are preferably moved by pivoting them, it also being possible for two functional components to be motion-coupled, as in the example of the pressing device 10 and the two clamping jaws 3, 4, which are moved via the vertical position of the pressing device 10 and thus the position of the curved segments 11.

A welding head that is designed in the manner described and a strapping machine are known for instance from DE 103 23 171 B4.

The general drive 12 and thus the movement of the functional components activated thereby and also the operation of additional functional components such as the feed device for supplying strap to a strap guide frame or the device for removing and supplying the packages, etc, which collectively are not shown in greater detail here, is now designed such that the motor or the drive 12 starts up only a single time within a strapping cycle, runs 360°, and brakes again. The progression of the inventive method can be seen in FIGS. 2-6 and 7.

Figure 2:
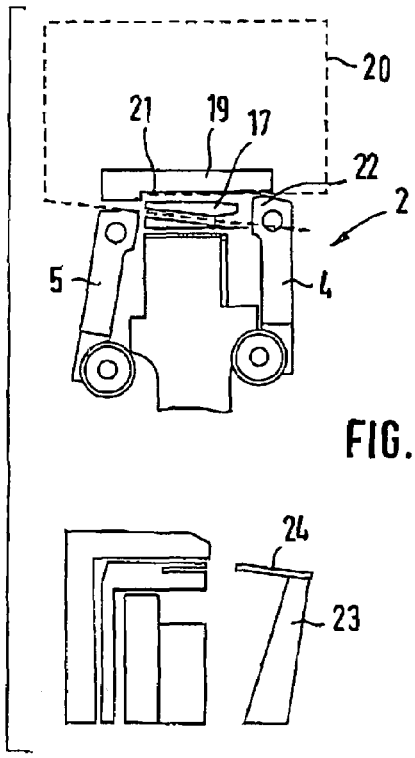
FIGS. 2-6 depict the principles for the welding head for the strapping device from FIG. 1 in different work situations during a strapping cycle.

FIG. 2 depicts as a partial cut-away of the strapping machine 1, the welding head 2 being in the starting position at the end of a strapping cycle or at the beginning of a subsequent strapping cycle. In this position, the strap 20 was fed into the strap guide frame (not shown in greater detail) via the feed device (also not shown in greater detail), and the leading strap end 21 was captured in the area between the counterpressure plate 19 and the strap guide device 17. At the same time, the drive 12, which was still rotating, actuated the right clamping jaw 4 so that the latter was moved into the clamping position and the clamping head 22 of the clamping jaw 4 engages the strap 20, as can be seen, and clamps it against the counterpressure plate 19. In contrast, the left clamping jaw 5 is not opened. When the strap is clamped, that is, the right clamping jaw 4 is actuated, the motor or drive cycle ends, which means that the drive 12 or the motor brakes and comes to a stop. During the next period the exchange of the package that was previously strapped concludes, which means that the strap is fed in, the strap is captured, and as the final cycle work step the strap is clamped by the right clamping jaw in the time interval in which the package exchange occurs. A side view of the welding head shown in the top part of the figure is provided at the bottom of FIG. 2 (and in subsequent FIGS. 3-6), and again it depicts the welding device 23 with the welding tongue 24, which in this end and start position is not arranged in the work area.

Figure 3:
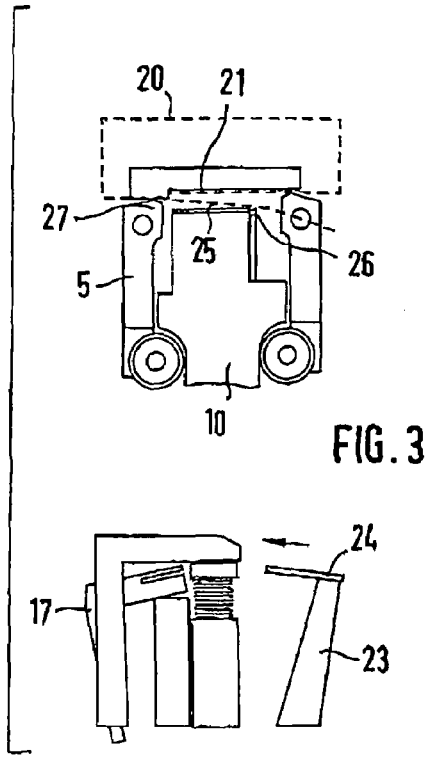

Once the package exchange has concluded, that is, when the new package to be strapped has been conveyed into the strap frame, the strap is pulled out of the strap guide frame by a strap retraction device (not shown in greater detail) and returned to the strapping machine, so that it is tensioned about the new package. During this tensioning step the drive 12 is still at rest, which means that it has not been actuated since the end of the drive cycle with the actuation of the right clamping jaw 4. The drive 12 is not actuated, and the motor does not start up and begin its work cycle, within which it runs 360° continuously without another stop, until the tensioning has concluded. FIG. 3 depicts the situation in which the tensioning has just occurred; as can be seen, the strap is substantially tighter about the package (not shown in greater detail). At the same time, the left clamping jaw 5, which was still released in the start position in accordance with FIG. 2, is in the clamping position, which means that the clamping head 27 also engages the strap 20, so that the latter is fixed at two locations. The clamping jaw 5 was also actuated via its motion coupling to the pressing device 10, which was controlled via the rotating drive 12 or the rotating drive shaft 13 and the cam disk 14. Then, immediately after the clamping using the left clamping jaw 5 the strap guide device 17 is moved out of the work area, as depicted in FIG. 3, and then the welding tongue 24 of the welding device 23 pivots into the work area between the strap ends that overlap one another, specifically the leading strap end 21 and the back strap end 25, which is cut on the pressing device 10 using a suitable cutting edge 26. The two overlapping strap ends are fused using the welding tongue 24. All of the movements are also controlled via the drive 12, which rotates further continuously.

Figure 4:
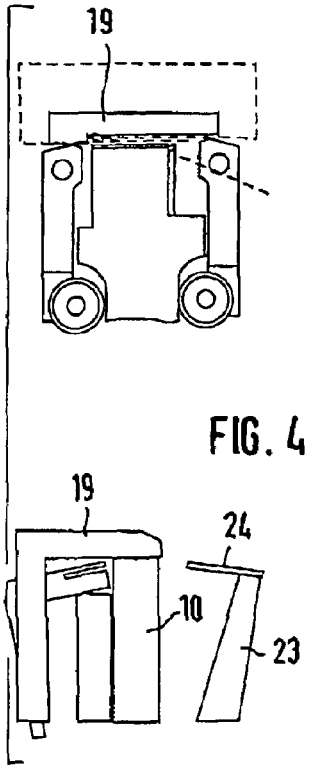

FIG. 4 now depicts the welding position in which, after the fusing, the welding device 23 and the welding tongue 24 have been removed from the work position, while the pressing device was raised and presses against the counterpressure plate 19, pressing the two strap ends 21, 25 securely against one another. This upward movement of the welding device 23 and the upward movement of the pressing device 10 also occur via the continuously rotating drive 12.

Figure 5:
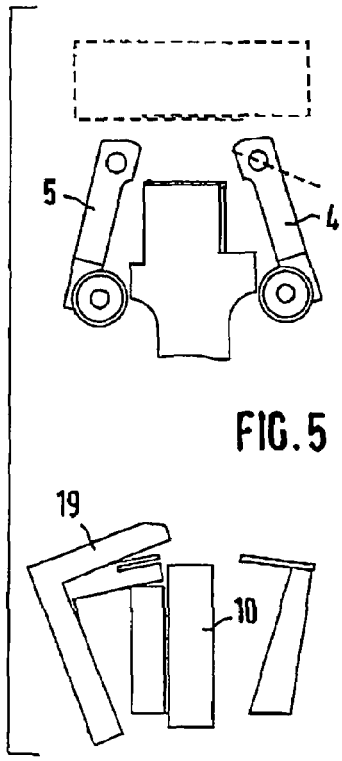
Figure 6:
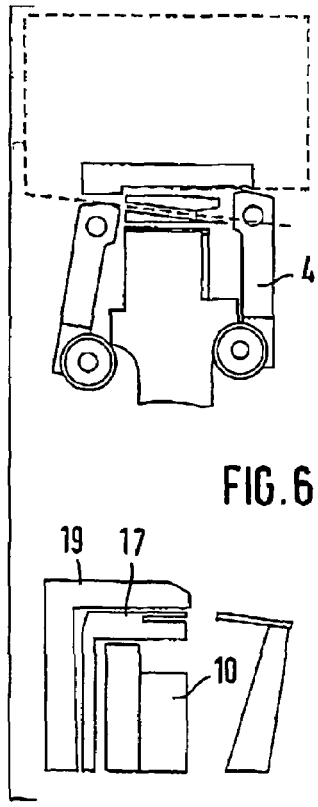

Once the welding or pressing has concluded, the counterpressure plate 19 is pivoted out of the work area via the rotating drive 12 so that the package is exposed (see FIG. 5). Because the counterpressure plate is disposed between the welded strap and the package during the welding in accordance with FIG. 4, it would not be possible to move the package out of this position. The package cannot be exchanged until it is exposed due to the counterpressure plate 19 pivoting out. Of course, at this point in time the two clamping jaws 4, 5 have also been released, which also occurs via the drive 12 using appropriate positioning of the pressing device 10, to which the two clamping jaws 4, 5 are coupled. This means that the package exchange can occur as soon as the counterpressure plate has been moved out of the work area. Regardless, the drive 12 continues to work and the drive shaft 13 is still rotating. Because immediately after the strapped package has been removed, the counterpressure plate 19 and the strap guide device 17 are brought into the work position via the drive 12, and the pressing device 10 is moved downward again so that new strap 20 can be fed into the strap guide frame, as is depicted in FIG. 6. As soon as the strap is fed in, the drive 12, which is still rotating, causes the clamping jaw 4 to resume the clamping position, whereupon the drive 12 immediately stops; its work cycle has now concluded. The assumed configuration or position of the functional components is the final position, but is also the starting position in accordance with FIG. 2. When the drive stops the strapping cycle has concluded and a new strapping cycle begins immediately thereafter with the tensioning of the strap 20 about the new package that has been supplied.

Figure 7:
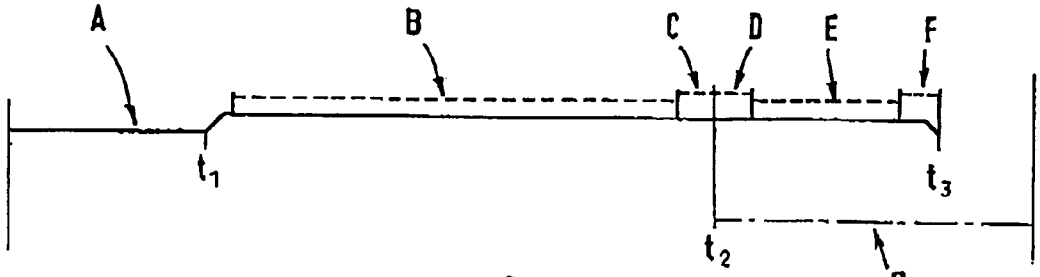
FIG. 7 depicts a progression for the method according to an embodiment of the invention.

FIG. 7 depicts the principle of the progression of the inventive method. The strapping cycle begins on the left, the strapping machine or welding head being disposed in the starting position in accordance with FIG. 2. The curve depicts the operation of the motor or drive, which is idle when the curve drops and works, that is rotates, when the curve is lifted. Occurring in the first segment identified as A is the tensioning of the strap, which has already been fed in, and which, as described with respect to FIGS. 2-6, is clamped at its leading end via the right clamping jaw 4. It is not until time $t_1$ that the drive 12 or the motor starts up, at which point, as identified with B, first the left clamping jaw 5 is actuated for clamping the tensioned strap at the other end, whereupon the welding tongue 24 is inserted and the other functional components are also actuated in order to then move the pressing device 10 against the counterpressure plate 19 to press the molten strap ends together. In the segment immediately thereafter, identified as C, as described the counterpressure plate 19 is briefly moved out of the work area, whereupon at time $t_2$ the exchange of the package begins, as is also depicted with the segment identified as D. The package, which is already strapped at time $t_2$, can be conveyed away. Segment C is very brief in duration because the removal of the package happens very quickly, and immediately thereafter is segment D, in which the counterpressure plate 19 is moved back into the work position. Naturally, while the package is being removed, that is, in segment C, the clamping device 3 is opened, that is, both clamping jaws 4, 5 are pivoted into the non-clamping position, and where necessary the pressing device 10 has also been moved downward.

Since during the segment D the strap guide device 17 is also moved back into the work area, immediately following method segment D, identified as E in FIG. 7, the in-feed process can occur, during which process the strap is fed into the strap guide frame and the leading end is captured between strap guide device 17 and counterpressure plate 19. This in-feed is immediately followed in the segment F by the clamping of the leading strap end 21 using the right clamping jaw 4, again controlled via the drive 12. The drive 12 or the motor is not turned off until then, time $t_3$ in FIG. 7. As can be seen, during the entire work interval from $t_1$-$t_3$ the drive 12 rotates without a single intermediate stop. It is essential in this regard that the clamping of the leading strap segment 21 in accordance with method segment F occurs at the end of the strapping cycle or during the time period for the package exchange in accordance with method segment G. When the package exchange has concluded in accordance with segment G, the cycle begins all over again, which means that the method progression begins again on the left in the diagram in accordance with FIG. 7 with the placement of the strap that has been fed in.

As can be seen, this enables rapid strapping, that is, a rapid cycle, because the motor or the drive is started up only one time in the cycle and stopped only one time in the cycle, and in between the drive rotates continuously. Compared to previous processes, the inventive method or a strapping cycle is consequently more rapid at least by the amount of time that is required for the first start up, clamping on the right side, and the first braking, which is still significant even in very short strapping cycles in the range of something greater than one second, including the package exchange. It is possible to reduce the cycle time by 10-20%. Moreover, the protection of the motor or the drive and all of its components that are started and stopped even only one time within a cycle is advantageous compared to the prior art.

Furthermore, due to the single, continuous running of the drive, there is even the possibility for having the drive run at a slower speed, since the required positioning and actuating processes can be controlled in somewhat longer windows of time than in the prior art.

Figure 8:
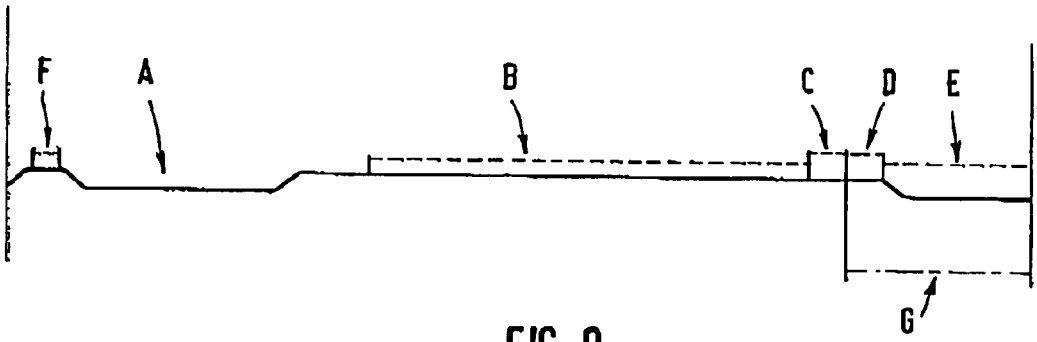
FIG. 8 PRIOR ART
FIG. 8 depicts a progression for a method in accordance with the prior art.

FIG. 8 merely depicts a corresponding method progression diagram for comparison purposes; it depicts the manner of working in accordance with the prior art. As can be seen (see FIG. 8, left), method step F occurs initially at the beginning, which means that the drive is started up, whereupon right strap clamping is actuated, and then the drive is immediately braked again. This is followed by method segment A (tensioning), at the end of which the drive is again started up in order to perform method segments B, C, and D. The drive is stopped again at the end of method segment D, in which the pressure plate is moved forward again. This is followed by another in-feed process, which means that the strap is fed in while the motor and drive are idle. The package exchange begins at the end of method segment C, that is, when the counterpressure plate is caused to move out. Only when the package exchange in accordance with segment E has concluded, and when the strap has also been fed in, can a new cycle begin in which in accordance with FIG. 8 initially the drive is first started up, etc.

The invention claimed is:

1. A method for strapping a package with a strapping machine that includes a motor drive having a drive shaft that rotates 360° within a strapping cycle and controls work components including at least one clamping device for the strap to be strapped, the method comprising:

removing a package already strapped in a first strapping cycle and feeding in a leading strap end of a strap to be strapped in a subsequent, second strapping cycle while said drive is in motion;

clamping said leading strap end, said clamping occurring during said first strapping cycle, in a time between a beginning of said removing the package already strapped in the first strapping cycle and an end of an addition of a new package to be strapped;

stopping the drive;

at the beginning of the second strapping cycle, tensioning the strap, which has previously been fed-in during said first strapping cycle, about the new package; and starting the drive and continuously rotating said drive 360° without an intermediate stop during said second strapping cycle until a subsequent leading strap end has been clamped.

2. The method according to claim 1, wherein said removing the package already strapped begins immediately after a pressure plate for the welding of the strap is moved out of a strap guide area using the movement controlled by the drive shaft and when the clamping device is open.

3. The method according to claim 2, wherein said removing the package is initiated at a remaining angle of rotation of said drive shaft about 160° before the end of completion of the 360° rotation thereof.

4. The method according to claim 3, wherein the remaining angle of rotation of said drive shaft at which said removing the package is initiated is at or up to 200° before the end of completion of the 360° rotation thereof.

5. A method for strapping a package with a strapping machine, said strapping machine including a motor drive having a drive shaft which rotates 360° within one strapping cycle, said drive shaft during its single 360° rotation during said strapping cycle controls work components of said strapping machine including at least one clamping device for the strap to be strapped, said method comprising:

at a beginning of a strapping cycle, tensioning the strap which has previously been fed into said machine and at a leading strap end of said strap has been clamped with said clamping device, about a package placed in said machine to be strapped;

starting said drive and continuously rotating said drive about the single 360° rotation thereof without an intermediate stop during said strapping cycle to conclude said strapping about said package, whereas towards an end of the strapping cycle said strapped package is removed and a new leading strap end of strap to be strapped during a subsequent strapping cycle is fed-in and clamped during said strapping cycle in a time between a beginning of said removing the package already strapped in the strapping cycle and an end of a placement of a new package to be strapped in said subsequent strapping cycle; and stopping the drive at the end of the strapping cycle.

* * * * *